US007852004B2

(12) United States Patent
Li et al.

(10) Patent No.: US 7,852,004 B2
(45) Date of Patent: Dec. 14, 2010

(54) IGNITION AID AND FITTING SHROUD FOR DISCHARGE LAMP

(75) Inventors: Jianwu Li, Solon, OH (US); Viktor K. Varga, Solon, OH (US); Agoston Boroczki, Rózsa (HU)

(73) Assignee: General Electric Company, Schenectady, NY (US)

( * ) Notice: Subject to any disclaimer, the term of this patent is extended or adjusted under 35 U.S.C. 154(b) by 481 days.

(21) Appl. No.: 11/810,471

(22) Filed: Jun. 6, 2007

(65) Prior Publication Data

US 2008/0303402 A1 Dec. 11, 2008

(51) Int. Cl.
*H01J 17/30* (2006.01)
*H01J 61/54* (2006.01)

(52) U.S. Cl. ..... 313/594; 313/607; 313/601

(58) Field of Classification Search ..... 313/594, 313/595, 607, 602, 283
See application file for complete search history.

(56) References Cited

U.S. PATENT DOCUMENTS

| | | | | |
|---|---|---|---|---|
| 4,053,809 | A | 10/1977 | Fridrich et al. | |
| 5,541,480 | A | 7/1996 | Renardus et al. | |
| 5,998,915 | A | 12/1999 | Scholz et al. | |
| 6,741,013 | B2 * | 5/2004 | Dakin et al. | 313/25 |
| 6,844,676 | B2 * | 1/2005 | Alderman et al. | 313/567 |
| 2001/0003411 | A1 | 6/2001 | Honda et al. | |
| 2002/0070644 | A1 | 6/2002 | Dakin et al. | |
| 2004/0119412 | A1 * | 6/2004 | Katou et al. | 313/607 |
| 2005/0042967 | A1 | 2/2005 | Jackson et al. | |

FOREIGN PATENT DOCUMENTS

| | | | |
|---|---|---|---|
| EP | 186 899 | B1 | 7/1986 |
| EP | 1 398 824 | B1 | 3/2004 |
| EP | 1 646 070 | B1 | 4/2006 |
| JP | 2006 294419 | | 10/2006 |

OTHER PUBLICATIONS

PCT/US2008/063142 International Search Report, mailed Dec. 3, 2008.

* cited by examiner

*Primary Examiner*—Karabi Guharay
(74) *Attorney, Agent, or Firm*—Fay Sharpe LLP

(57) ABSTRACT

An ignition aid (50, 60, 70, 80, 100, 120, 130, 150, 160, or 170) is provided for an HID lamp (20). Particularly the ignition aid includes an electrically conductive coil or coil portions wrapped around selected portions of the arc tube to act as the ignition aid and lower the breakdown voltage. In other embodiments, starting aids, and particularly one or more turns of the conductive coil or coil portions support the arc tube within an opening of a surrounding shroud (90) and thereby control the spacing between the arc tube (20) and the shroud (90). This limits the maximum thermal stress of the arc tube within a desired range.

6 Claims, 6 Drawing Sheets

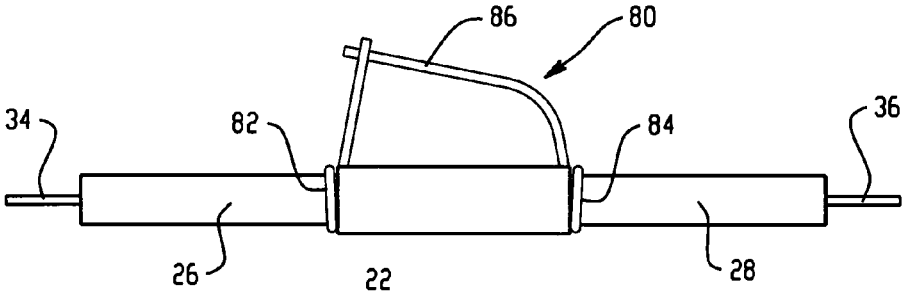
Fig. 5
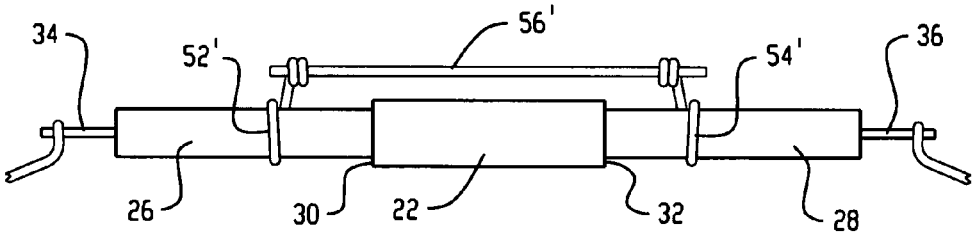
Fig. 6
| | | IGNITION PULSE | | | |
|---|---|---|---|---|---|
| | | FIGURE 2 | FIGURE 3 | FIGURE 5 | FIGURE 6 |
| | | PERCENT | PERCENT | PERCENT | PERCENT |
| COLD START | OFF 1 HOUR | 51 | 65 | 48 | 67 |
| HOT RE-STRIKE | OFF 12 SECONDS | | | 68 | 76 |
| | OFF 18 SECONDS | | | 64 | 68 |
| | OFF 1 MINUTE | 42 | 58 | 57 | 64 |
| | OFF 2 MINUTES | 39 | 48 | 58 | 71 |
| | OFF 3 MINUTES | 36 | 47 | 54 | 68 |
| | OFF 4 MINUTES | 35 | 58 | 49 | 68 |
| | OFF 5 MINUTES | 36 | 51 | 43 | 72 |
| MEAN | | 40 | 54 | 55 | 69 |
Fig. 7

IGNITION AID AND FITTING SHROUD FOR DISCHARGE LAMP

BACKGROUND OF THE INVENTION

This disclosure relates to a discharge lamp, such as an automotive headlamp, and more particularly to an ignition aid therefor. In addition, the disclosure relates to an ignition aid that serves as a support for controlling the gap between an arc tube and surrounding shroud so that a maximum thermal stress of the arc tube is within a desired range. It will be appreciated, however, that the disclosure finds application in related environments and applications.

High intensity discharge (HID) lamps require very high ignition voltages to break down a gap and initiate an arc between spaced electrodes. For example, an ignition pulse on the order of approximately 25 kV is required to start an automotive discharge headlamp. As will be appreciated, this high ignition voltage presents a challenge to lamp designers to provide a ballast that meets these requirements, and typically results in increased lamp component costs. In addition, electromagnetic interference (EMI) becomes an issue at these high voltages and often requires a ground or shield to contain the EMI and not adversely impact nearby electrical components.

In addition, ceramic discharge headlamps have thermal stress issues. One manner of addressing the thermal stress is to use a shroud that fits closely around the arc tube. The spacing between the shroud and the arc tube must be small, for example on the order of approximately one (1) millimeter. However, it is difficult to maintain this spacing during the assembly process.

One known ignition aid for reducing a starting or ignition voltage for a discharge lamp is shown and described in commonly owned U.S. Pat. No. 4,053,809. That disclosure is directed to a short arc discharge lamp where the spaced electrodes are sealed in a thick-walled quartz envelope. The electrode gap or arc length is about 2 or 3 millimeters in an exemplary 300 watt metal halide gas short arc discharge lamp. The tungsten wire electrodes are received in an ionizable fill which includes an inert gas such as argon and a halogen or metal halide such as indium iodide. An elongated electrically conductive member is connected to one of the electrodes or inleads, and the conductive member extends toward the other electrode to serve as a starting device, or ignition aid. One embodiment of the starting device described therein includes a wire welded at one end to a first electrode and connected at an opposite end to a metal strap that encircles a stem of a second electrode. The starting device is spaced closer to the second electrode than the arc gap between the electrodes. In this manner, the starting voltage for the lamp is significantly reduced.

Another approach for a starting aid is taught in U.S. Pat. No. 5,541,480 where a high pressure discharge lamp employs a metal coating on an outer surface of a ceramic wall of the lamp. More particularly, the metal coating is a high temperature metal sintered on the ceramic wall that serves as the starting aid. Unfortunately, this arrangement requires a high temperature material in order to survive the sintering process and the process is relatively expensive in order to maintain good contact.

Yet another starting aid arrangement is disclosed in US2005/0042967 A1 which uses a conductive antenna coil wrapped around an arc tube in order to reduce the breakdown voltage of the lamp fill gas. The coil also provides containment protection to prevent damage to an outer bulb if the arc tube were to rupture.

A need exists for substantially reducing the ignition voltage necessary to start a discharge lamp, and also to support a shroud in closely spaced relation with the arc tube such that the maximum thermal stress of the arc tube is maintained within a desired range.

BRIEF DESCRIPTION OF THE INVENTION

A ceramic discharge lamp includes a body and a leg extending outwardly from the body at a joint. First and second electrodes have terminal ends separated by a discharge gap within the body. An ignition aid conductive member extends about at least one of the body and leg in a region encompassing the first electrode and the ignition aid conductive member mechanically and/or electrically connects to one of the first and second electrodes.

A containment shroud is received around the lamp and the ignition aid conductive member is dimensioned to support the lamp within an opening of the shroud.

The ignition aid conductive member includes a coil portion wrapped around at least one of the body and a leg.

The ignition aid conductive member preferably includes first and second coil portions received over respective first and second legs of the lamp.

The ignition aid conductive member is electrically connected to one of the first and second electrodes.

In another preferred arrangement, first and second coil portions are received over respective first and second legs of the lamp.

In another embodiment, the ignition aid conductive member is mechanically connected to at least one of the first and second electrodes.

In those embodiments incorporating a containment shroud, the ignition aid conductive member is also advantageously used to support the shroud around the lamp.

In selected embodiments, the ignition aid is only electrically coupled to either one or both of the first and second electrodes.

A primary benefit is the provision of an ignition aid to lower the breakdown voltage associated with a discharge lamp.

Another benefit resides in the use of the ignition aid as a support to control the spacing between the discharge lamp and a surrounding shroud so that the maximum thermal stress of the lamp is within a desired range.

Still other benefits and advantages of the present disclosure will become apparent from reading and understanding the detailed description below.

BRIEF DESCRIPTION OF THE DRAWINGS

FIGS. 2-6 are elevational views of discharge lamps having different embodiments of ignition aids.

FIG. 7 is a table representing the reduced ignition pulse associated with cold start and hot re-strikes comparing discharge lamps with the ignition aid and without the benefit of the ignition aid.

DETAILED DESCRIPTION OF THE INVENTION

Figure 1:
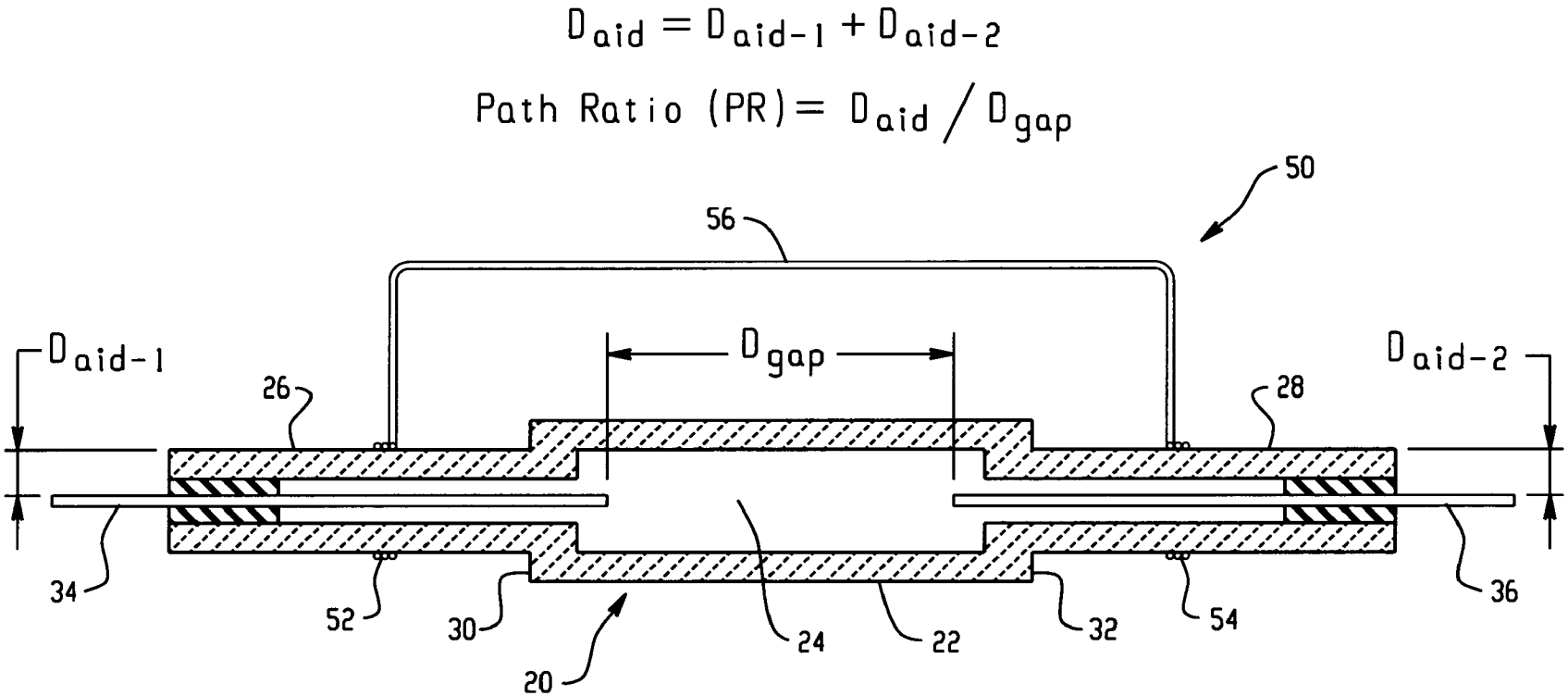
FIG. 1 is a longitudinal, cross sectional view of a discharge lamp having an ignition aid incorporating features of the present disclosure.

Turning to FIG. 1, illustrated is a lamp or high intensity discharge (HID) lamp 20 having an arc tube envelope or body 22 formed from a translucent material such as quartz, polycrystalline sapphire, or polycrystalline alumina that encompasses or encloses a cavity or arc tube chamber 24. A ceramic metal halide (CMH) is a popular type of discharge lamp that is desirable for use in a wide variety of applications including, for example, use as a light source in an automotive discharge headlamp. Opposite, reduced diameter first and second ends or legs 26, 28 extend from and abut with the body at respective shoulders 30, 32. The arc tube legs have reduced dimensioned openings through which extend first and second electrodes 34, 36 that extend into the chamber and terminate at a spaced dimension or gap from one another. An arc is formed between the electrodes when sufficient voltage is supplied thereto and the arc ionizes the fill in the chamber 24.

The high ignition voltage required to break down the gap and initiate the arc can be altered through use of a conductive ignition aid or starting device 50. For example, any electrically conductive material can be used to make a coil act as an ignition aid and reduce a length of a breakdown path. More particularly, a distance $D_{gap}$ between the electrodes 34, 36 and the distance $D_{aid}$ of the ignition aid 50 should be shorter than the gap $D_{gap}$ between the first and second electrodes. Here, $D_{aid}(D_{aid\text{-}1}+D_{aid\text{-}2})$ is the distance from an outer surface of the electrode to an inner diameter or inner surface of the ignition aid 50. As represented in FIG. 1, the ignition aid 50 includes a first coil portion 52 that is wrapped multiple times around the first leg 26, preferably at a dimension longitudinally spaced from the shoulder 30, and a second coil portion 54 wrapped multiple times around the second leg 28 and likewise longitudinally spaced from shoulder 32. In this arrangement, the ignition aid is not physically or in direct mechanical engagement with the electrodes. Rather, the ignition aid is referred to as electrically connected or electrically floating, or alternatively referred to as forming a conductive coupling or capacitive coupling with the electrode. An ignition voltage reduction percentage depends on a path ratio PR represented as $D_{aid}/D_{gap}$ as shown in FIG. 1. A smaller path ratio PR results in a larger ignition voltage reduction. Thus, in the illustrated embodiment of FIG. 1, the $D_{aid}$ of the discharge path is essentially the diameter of the legs, i.e., the radial dimension from the outer surface of the first electrode 34 to the inner surface of the first coil portion 52 combined with the radial dimension from the outer surface of the second electrode 36 to the inner surface of the second coil portion 54. Additionally in the embodiment of FIG. 1, the ignition aid 50 includes an interconnecting portion or wire 56 that electrically (and mechanically) interconnects the first coil with the second coil and extends longitudinally along the lamp body. By way of example only, the $D_{gap}$ may be on the order of approximately seven to eight millimeters (7-8 mm) and the leg diameters are about three millimeters (3 mm). Of course one skilled in the art will appreciate that other dimensions may be used without departing from the scope and intent of the present disclosure. However, to distinguish from what in the industry are known as short arc lamps, a body length to leg outer diameter ratio is greater than 2.5, more preferably greater than 4.0.

Figure 2:
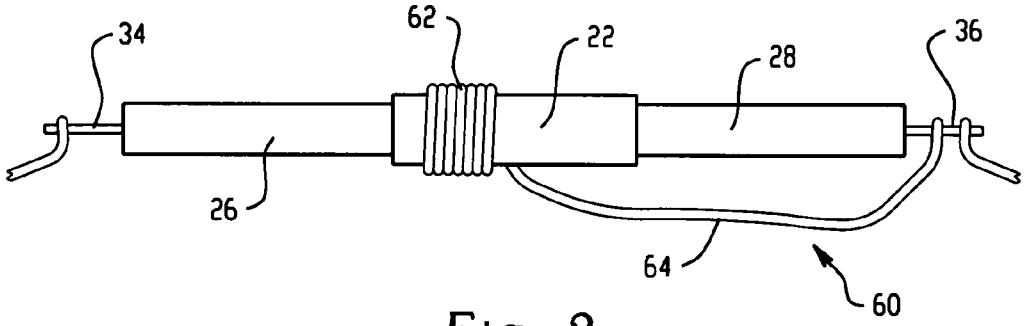

With the general concepts of FIG. 1 identified, other embodiments are shown and described further below. For purposes of consistency and brevity, like reference numerals identify like components of the arc tube lamp, and the alternative arrangements of the ignition aid are identified by new numerals. For example, in the embodiment of FIG. 2, an ignition aid 60 is wrapped multiple times in a capacitive coupling relation around a central portion of the body to form a coil 62 and a wire portion such as nickel plated wire 64 extends longitudinally adjacent one of the legs, here the second leg 28, where the wire is mechanically and electrically connected to the second electrode 36. This arrangement is not as desirable as others described herein because the body of the arc chamber is at an elevated temperature and contact with the ignition aid, which is at a lower temperature, could impart thermal stress to the lamp assembly. Additionally, the wrapping of the ignition aid wire along the body may adversely impact the optics of the lamp assembly.

Figure 3:
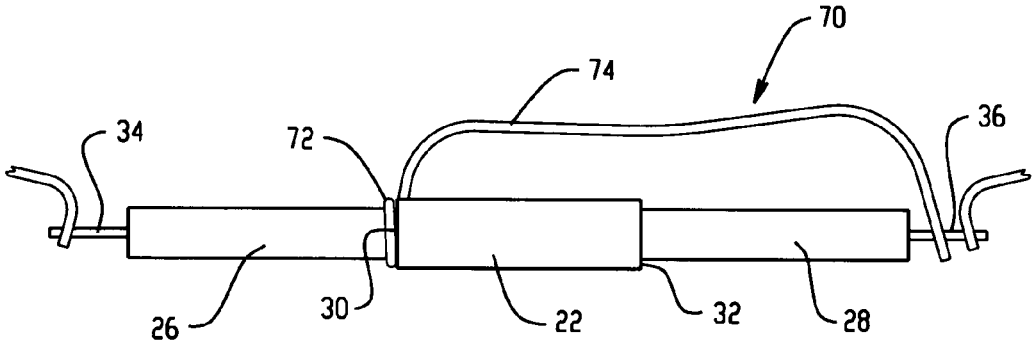

In FIG. 3, ignition aid 70 includes a first portion or coil 72 wrapped around the first leg. Preferably, the coil 72 preferably has a single turn and is positioned on the leg at or adjacent the first shoulder 30 where the temperature of the lamp is reduced relative to the body. Moreover, abutting the ignition aid 70 against the shoulder is desirable from a manufacturing standpoint since the relative locations of the components are repeatable. Further, the $D_{aid}$ of the ignition aid is less than the FIG. 2 embodiment because the leg has a smaller diameter than the diameter of the body. A wire portion 74 extends to the other end of the lamp where the wire portion is mechanically and electrically connected to the second electrode 36. As is further illustrated, the wire portion 74 is spaced from the arc tube body as the wire portion proceeds axially in offset relation with the arc tube toward the second electrode connection.

Figure 4:
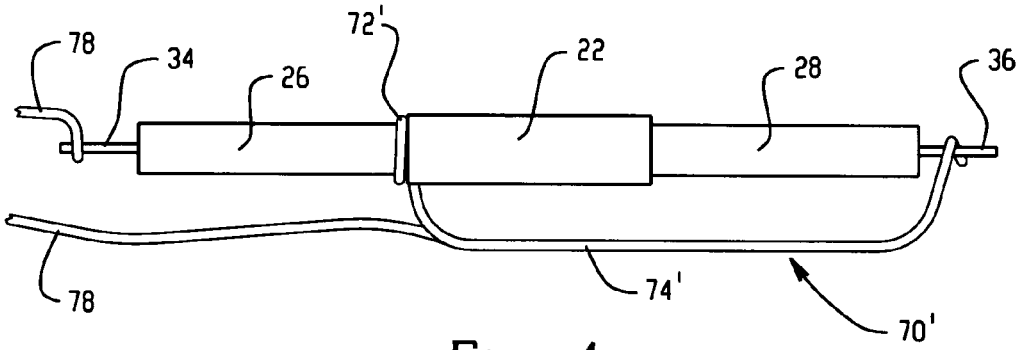

A single ended discharge lamp is shown in FIG. 4. This embodiment is substantially identical to the arrangement of FIG. 3 so that primed suffixes (') are used to identify the components. That is, ignition aid 70' has a single turn coil 72' located at the shoulder junction of the first leg 26 and the body 22. Wire portion 74' extends parallel to a longitudinal axis of the arc tube where the wire portion is mechanically and electrically connected to the second electrode 36. Because this lamp is used in a single ended orientation, i.e., where external electrical lead wires 78 are both disposed at one end, connection of the second electrode with the associated external lead wire is achieved by connecting to the starting aid 70'. Although the connection could be made anywhere along the length of the ignition aid, the ignition aid/external lead wire connection is preferably adjacent the coil 72' since the coil is disposed closer to the external lead wire 78.

The arrangement of FIG. 5 has an ignition aid 80 that includes first and second coil portions 82, 84 wrapped around respective first and second legs at or adjacent the shoulders. Although the shoulder locations are desirable from a manufacturing standpoint, it is believed that positioning of the ignition aid 80 at that location may contribute to thermal stresses at the joints of the respective legs and body. Further, the coil portions 82, 84 are capacitively coupled with a respective electrode and in this arrangement each coil portion constitutes only a single turn, while the interconnecting wire portion 86 extends generally parallel to the arc tube body in an offset relation.

Thus, the preferred embodiments of FIG. 1 and FIG. 6 include the benefit of moving the coil portions 52', 54' away from the respective shoulders 30, 32 (and therefore not contribute to thermal stress at the joints between the respective legs and the body) but are advantageously wrapped about the smaller diameter legs to reduce $D_{aid}$. It will be understood that other embodiments may have selected ones of the desired characteristics for use under selected circumstances. FIG. 6 is otherwise substantially similar to FIG. 1 except that the first and second coil portions 52', 54' are a single turn only in the FIG. 6 arrangement.

FIG. 7 is a table that illustrates the improvement in the ignition pulse as required to ignite the lamp, or start the arc, either after a cold start or a hot re-strike. Particularly, the table generally illustrates the improved percentages that resulted from comparing either a cold start or a hot re-strike of a lamp without the coil (or ignition aid) with a lamp that included an ignition aid as shown in the embodiments of the different lamp configurations of FIGS. 2, 3, 5, and 6 (that is, the ignition voltage values with the ignition aid are divided by the ignition voltage values without the ignition aid to provide the percentage values listed in FIG. 7). The percentage reduction of a required ignition voltage pulse to strike the arc is significant with use of the ignition aid, ranging from a mean of 40% with the embodiment of FIG. 2 to a mean percentage of 69% with the arrangement of FIG. 6.

Figure 8:
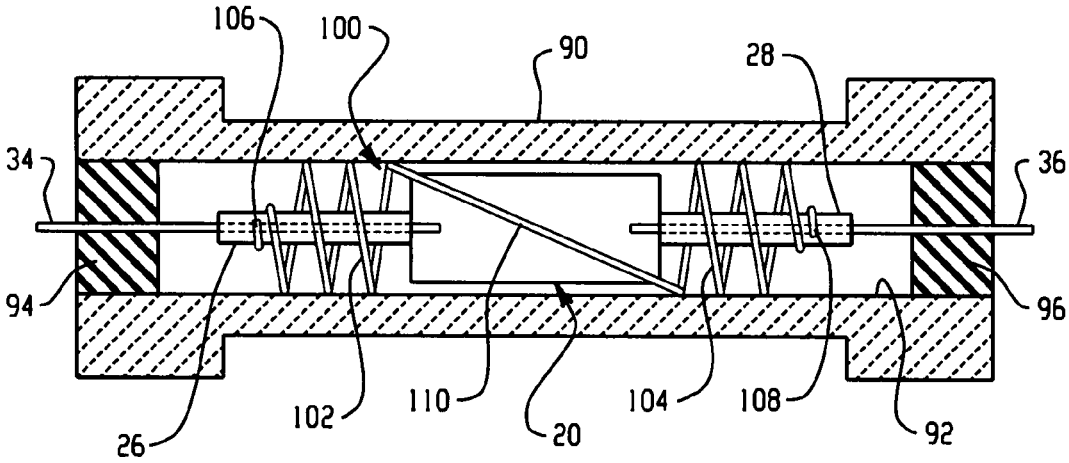
FIGS. 8-11 illustrate different embodiments of ceramic metal halide lamps where the starting aid also serves to support a close fitting shroud about the discharge lamp.

FIG. 8 shows an arrangement where the ignition aid also serves as a support for a fitting shroud received around the CMH lamp. As is known in the art, a tight fitting shroud is often used to control the thermal stress in a CMH lamp. However, this requires a small gap or spacing between the arc tube and surrounding shroud. The small spacing is on the order of approximately 1 millimeter (1 mm) and thus it presents a challenge to maintain such a close fit relation. A shroud 90 includes a through opening forming an inner wall 92 dimensioned to freely receive the HID lamp or CMH lamp 20 therein. Seal plugs 94, 96 are provided at opposite ends to close off or to close the opening, but permit the electrical lead to extend therethrough.

In the embodiment of FIG. 8, starting aid 100 also serves function of supporting the fitting shroud 90 around the lamp and maintaining a close spacing between the body of the lamp and the inner wall 92 of the shroud. This is important for controlling thermal stress as previously noted. Thus, the starting aid 100 includes multiple turn coil portions 102, 104 that include at least one turn 106, 108, respectively having a dimension that is substantially the same as the outer dimension of the arc tube legs 26, 28. This locates the starting aid relative to the arc tube. The remaining turns of the coil portions 102, 104 have an outer diameter substantially equal to the inner diameter of opening 92 in the shroud. In this way, the shroud 90 is supported by at least one turn, here three turns, of the coil portions at each end to prevent the arc tube from contacting the shroud which would otherwise induce thermal shock and potentially break the arc tube. It also maintains a consistent, small space. In addition, there is an interconnecting wire portion 110 that extends between the first and second coil portions 102, 104. In this manner, the starting aid does not adversely impact the optics of the lamp.

Figure 9:
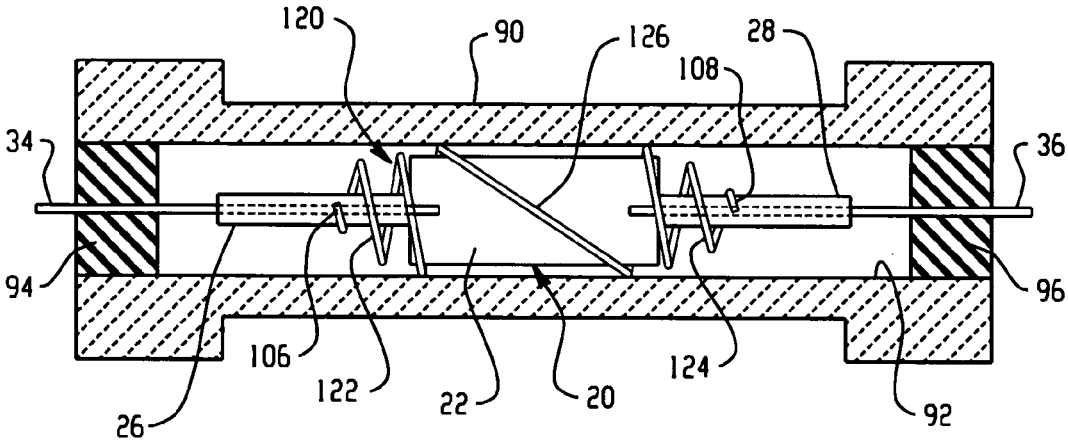

The embodiment of FIG. 9 is slightly different in that starting aid 120 includes first and second coil portions 122, 124 that include multiple turns about respective arc tube legs 26, 28, and at least one enlarged diameter turn having an outer diameter approximating that of the opening 92 of the shroud. More importantly, this large diameter turn is located at each end of the arc tube body, with an interconnecting wire portion 126. Like the embodiment of FIG. 8, the capacitive coupling of the starting aid with the electrode ensures that inductive power is provided to the coil portions. Smaller turns of the starting aid are positioned around the legs and the largest turn of each coil portion is disposed over the ends of the body to adequately support the arc tube in the shroud. This arrangement is deemed to be slightly more reliable than that of FIG. 8 because the larger diameter coil portions are located around the high temperature body and therefore preclude the body from contacting the shroud. This arrangement is also better able to withstand vibration.

Figure 10:
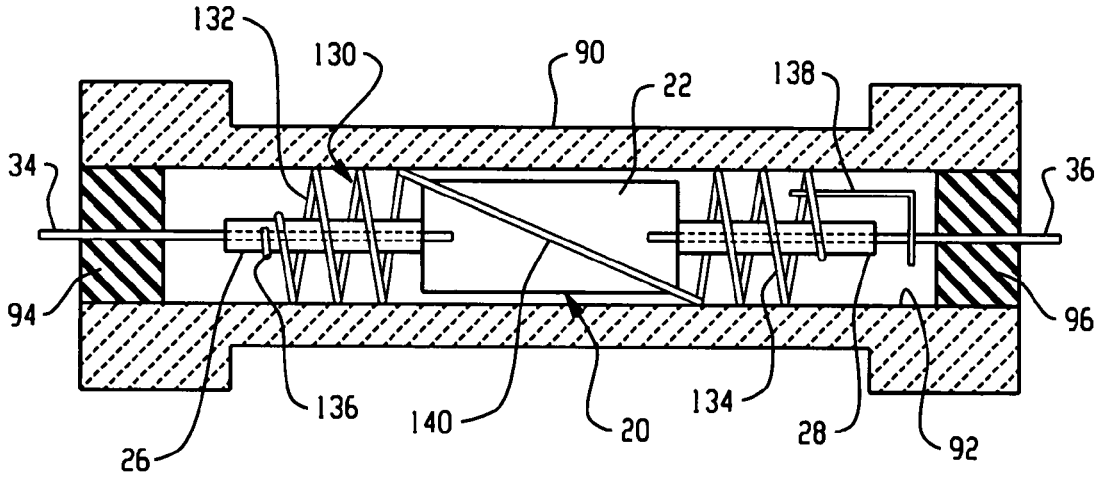

FIG. 10 includes a starting aid 130 having enlarged, multiple turn coil portions 132, 134 over the respective legs of the arc tube. The first coil portion 132 includes a small diameter turn at an end dimensioned to engage the first leg and likewise the second coil portion 134 has a small diameter turn at an end dimensioned to engage the second leg. The second coil portion 134 does not electrically float or capacitively couple with the electrodes, but rather is mechanically and electrically connected to the second lead 36 via connecting portion 138. This results in the coil having the same electrical potential as one of the leads. In addition, interconnecting wire portion 140 connects the first and second coil portions 132, 134.

Figure 11:
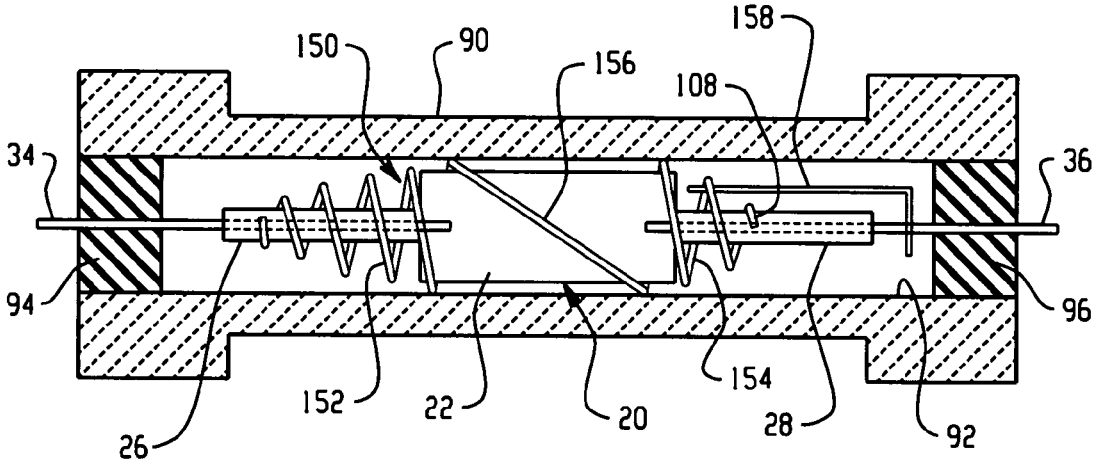

The embodiment of FIG. 11 includes a starting aid 150 that is essentially a hybrid combination of the embodiments of FIGS. 9 and 10. A first coil portion 152 has turns of varying diameter, and at least one turn is dimensioned for engaging receipt with the first leg 26 of the arc tube. The first coil portion also includes a large diameter turn over a first end of the body 22 to assure that the arc tube body does not contact the shroud 90. The interconnecting wire portion 156 then proceeds to the second coil portion 154 that has a large diameter turn over the second end of the arc tube body, and one or more smaller diameter turns that extend over the second leg 28 of the arc tube. The second coil portion 154 is also electrically and mechanically connected to the second lead 36.

Figure 12:
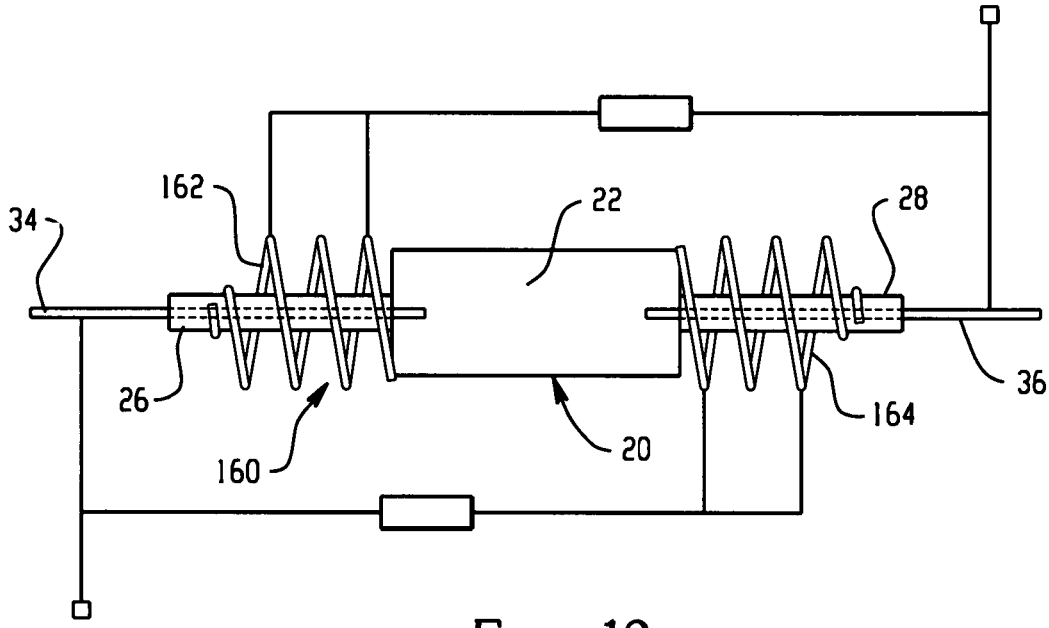
FIGS. 12 and 13 are schematic illustrations of the electrical connections of the lamp electrodes and starting aid with the power source.

FIG. 12 illustrates an HID lamp 20 that does not include a shroud. This embodiment bears some similarity to that of FIG. 10, however, there is no shroud, and the starting aid 160 includes distinct, separate portions, namely first coil portion 162 and second coil portion 164. Each of the coil portions 162, 164 has multiple turns, at least one of which is dimensioned to engage the outer diameter of a respective arc tube leg 26, 28 and another end of which is mechanically and electrically connected to the opposite end electrode 34, 36. It will be appreciated, however, that the remaining turns may be enlarged, and are connected to the lead opposite the leg around which it is wrapped. As a result, the discharge path is essentially the radius of the legs.

Figure 13:
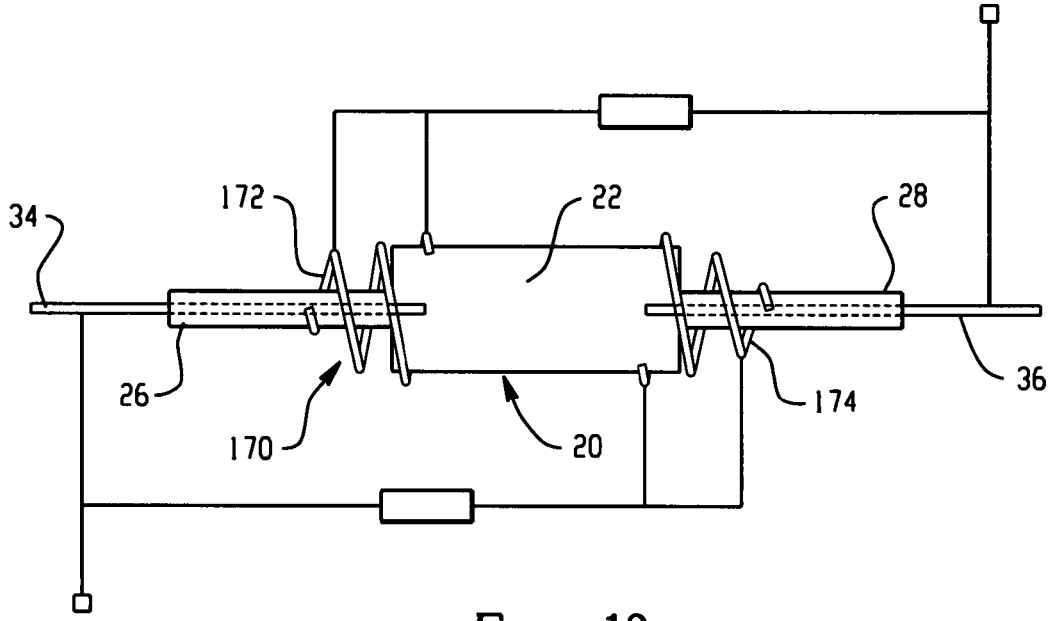

FIG. 13, at least one of the turns of each coil portion of the starting aid 170 is dimensioned to engage a respective arc tube leg, while another larger diameter coil turn is dimensioned for receipt around the respective end of the body.

The invention has been described with reference to the preferred embodiments. Obviously, modifications and alterations will occur to others upon reading and understanding the preceding detailed description. It is intended that the invention be construed as including all such modifications and alterations.

What is claimed is:

1. A ceramic discharge lamp comprising:

a body and a leg extending outwardly from the body at a joint;

first and second electrodes having terminal ends separated by a discharge gap within the body;

an ignition aid conductive member extendin about least one of the body and leg in a region encompassing the first electrode, and wherein the ignition aid conductive member is one of capacitively coupled, mechanically connected to, and electrically connected to one of the first and second electrodes; and a containment shroud received around the lamp, and wherein the ignition aid conductive member is dimensioned to engage the containment shroud along a lonsitudinal length thereof adjacent the body, wherein the ignition aid conductive member has a first portion dimensioned to engage an interior wall of the containment shroud and a second portion dimensioned to engage the lamp.

2. The lamp of claim 1 further comprising first and second coil portions received over respective first and second legs of the lamp, and mechanically and electrically connected to the first and second electrodes, respectively.

3. The lamp of claim 2 wherein the first and second coil portions also extend at least partially over the body.

4. A ceramic discharge lamp comprising:

a body and a leg extending outwardly from the body at a joint;

first and second electrodes having terminal ends separated by a discharge gap within the body;

an ignition aid conductive member extending about at least one of the body and leg in a region encompassing the first electrode, and wherein the ignition aid conductive member is one of capacitively coupled, mechanically connected to, and electrically connected to one of the and second electrodes; and a containment shroud received around the lamp, and wherein the ignition aid conductive member is dimensioned to engage the containment shroud along a longitudinal length thereof adjacent the body, wherein the ignition aid conductive member has a first portion dimensioned to engage an interior wall of the containment shroud and a second portion that mechanically engages a lead.

5. The lamp of claim 4 further comprising first and second coil portions received over respective first and second legs of the lamp, and mechanically and electrically connected to the first and second electrodes, respectively.

6. The lamp of claim 5 wherein the first and second coil portions also extend at least partially over the body.

* * * * *